United States Patent [19]

Park

[11] 4,409,595

[45] Oct. 11, 1983

[54] STRIPLINE SLOT ARRAY

[75] Inventor: Pyong K. Park, Canoga Park, Calif.

[73] Assignee: Ford Aerospace & Communications Corporation, Detroit, Mich.

[21] Appl. No.: 342,323

[22] Filed: Jan. 25, 1982

Related U.S. Application Data

[63] Continuation of Ser. No. 147,416, May 6, 1980, abandoned.

[51] Int. Cl.[3] ..... H01Q 13/10

[52] U.S. Cl. ..... 343/771

[58] Field of Search ..... 343/700 MS, 770, 771, 343/737, 738, 806

[56] References Cited

U.S. PATENT DOCUMENTS

| | | | |
|---|---|---|---|
| 2,914,766 | 11/1959 | Butler | 343/771 |
| 3,031,666 | 4/1962 | Butler | 343/771 |
| 3,044,066 | 7/1962 | Butler | 343/771 |
| 3,228,030 | 1/1966 | Moore | 343/746 |
| 3,302,207 | 1/1967 | Hoffman | 343/731 |
| 3,569,973 | 3/1971 | McFarland et al. | 343/753 |
| 3,823,404 | 7/1974 | Buie, Jr. | 343/708 |
| 3,971,032 | 7/1976 | Munson et al. | 343/770 |
| 4,054,874 | 10/1977 | Oltman, Jr. | 343/700 MS |
| 4,130,822 | 12/1978 | Conroy | 343/700 MS |

FOREIGN PATENT DOCUMENTS

| | | | |
|---|---|---|---|
| 1247546 | 9/1971 | United Kingdom | 343/771 |
| 1294024 | 10/1972 | United Kingdom . | |

OTHER PUBLICATIONS

Strumwasser et al., "Slot Study in Rectangular TEM Transmission Line", Hughes Aircraft, Report TM 265 1/52.

*Primary Examiner*—Eli Lieberman

*Attorney, Agent, or Firm*—Peter Abolins; Edward J. Radlo; Robert D. Sanborn

[57] ABSTRACT

This specification discloses how to control the resonant slot length fed by a boxed strip line and a slot array antenna which uses a standing wave to form a broadside and an off broadside main beam. A plurality of linearly arranged elongated slots are fed by one continuous stripline feed conductor. The conductor has conductor portions each associated with one slot and each having a longitudinal axis which is angled with respect to the longitudinal axis of the associated slot. The conductor portions form a zig-zag pattern, adjacent slots having conductor portions angled at a different direction with respect to the direction of alignment of the slots.

8 Claims, 6 Drawing Figures

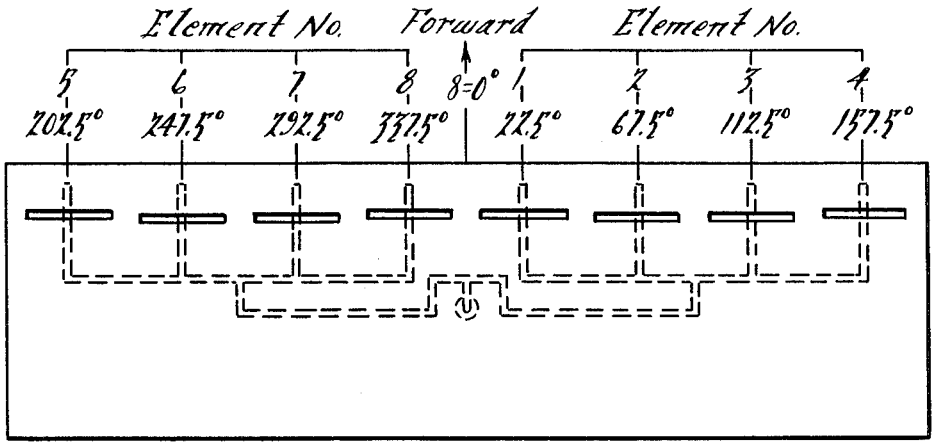
Prior Art
FIG. 1.
FIG. 4A.
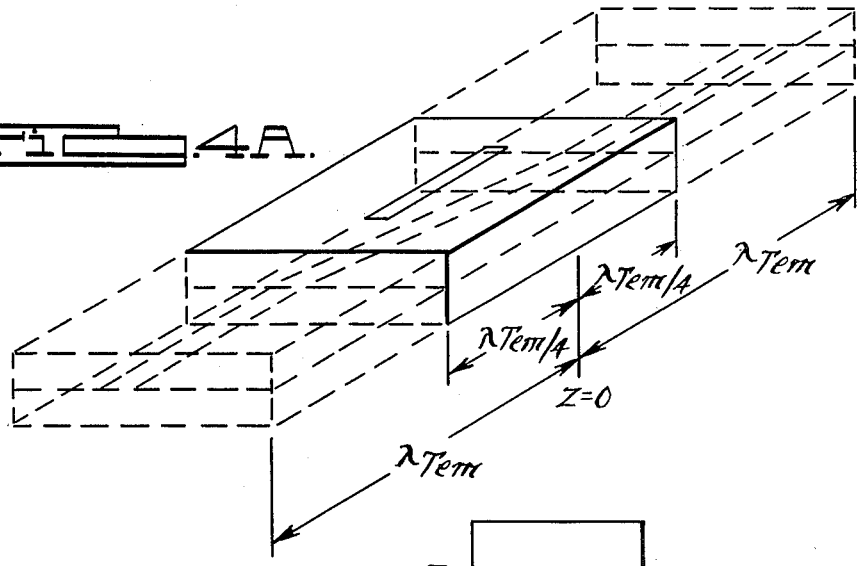
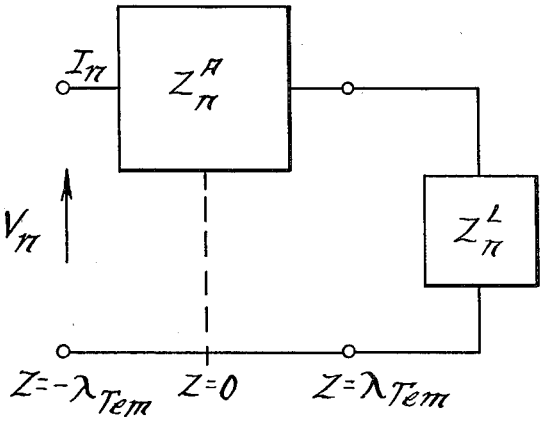
FIG. 4B.

STRIPLINE SLOT ARRAY

This is a continuation of application Ser. No. 147,416, filed May 6, 1980, now abandoned.

BACKGROUND OF THE INVENTION

1. Field of the Invention

This invention relates to antenna elements; and, in particular, to a stripline fed linear slot array antenna.

2. Disclosure Statement

The initial work on waveguide slot radiators was performed during World War II, as reported later by Watson in "Resonant Slots", IEE Journal, Vol. 93, Part 3A, pp. 747-777, 1946 and in a paper by Stevenson entitled "Theory of Slots in Rectangular waveguides", J Appl. Physics, Vol. 19, pp 24-38, 1948. An early study of stripline fed slots is reported in Strumwasser et al, "Slot Study in Rectangular TEM Transmission line", Hughes Aircraft Company, Report TM 265, January, 1952 and discusses a linear slot array fed by a single continuous TEM transmission line. In the Strumwasser et al study, a sixteen-element linear array of inclined longitudinal slots was designed empirically, neglecting TEM line attenuation and mutual coupling. A fundamental difficulty was encountered with excessive resonant slot lengths, which was only partially solved by loading the slot ends in dumb bell fashion. Since the slot spacing was greater than one-half guide wavelength, this configuration was limited to travelling wave arrays with the main beam scanned at least one beamwidth towards endfire. A 30 dB Chebyshev distribution was used in the design and a 22 dB sidelobe level was achieved. The input VSWR was 1.34:1. The TEM line was dimensioned so that all waveguide modes were cut off, and a plurality of inclined series slots were centered over a straight inner conductor. The resonant slot lengths in this configuration were longer than a half-guide wavelength, necessitating an empirical loading method to resonate the slots. The lengths were still too great to permit a standing wave array design (half-wave spacing), so only traveling wave arrays are studied. The inclined series slot also generated a cross-polarized component in the radiated field, which is equivalent to an efficiency loss. These are some of the problems this invention overcomes.

The use of a stripline corporate feed for a linear slot array was first reported in Sommers, "Slot Array Employing Photoetched Tri-plate Transmission Line", IRE Conv. Rec., Vol. MTT-3, pp. 157-162, March 1955 and has been widely used since that time (see FIG. 1). A corporate power divider network was used in which each divider output line was terminated in a cavity-backed slot transverse to the direction of propagation. The slots were aligned in a collinear array. Variable power divider ratios and branch line lengths were used to control the array amplitude and phase distributions. Mutual coupling effects did not enter into the design. This type of array requires empirical optimization of the cavity dimensions. These are yet other problems this invention overcomes.

SUMMARY OF THE INVENTION

This disclosure teaches a linear array of slots with no cross polarization and constrains the resonant slot lengths to advantageously low values. In accordance with an embodiment of this invention, a stripline-fed linear slot array antenna has slots fed from one continuous strip without the use of power dividing junctions. The conductor has a zig-zag pattern so that adjacent slots have conductor portions angled at a different direction with respect to the direction of alignment of the slots. Multiple arrays of this type can be stacked to form a high gain antenna with a pencil beam for radar and communications applications.

The stripline center conductor is enclosed in a dielectric-filled metal box, and the slots are located in one wall of the box. In addition to using a standing wave to form an off broadside main beam, this invention may be used in standing wave arrays with broadside beams or in traveling wave arrays having off-broadside beams. The feeding of the slots from a single strip eliminates the multiple power dividing junctions currently used in stripline fed linear slot arrays. The tilt angle of the center conductor relative to the long axis of the slot above the strip determines the amount of energy coupled from the strip to the slot. There is zero or minimum coupling when the slot and strip are parallel and maximum coupling when the slot and strip are orthogonal. Therefore a very large range of coupling values are available without varying the external slot configuration and without the use of power dividers.

A linear array of slots in the outer wall of a boxed stripline has several advantages when compared to an equivalent array of slots in a $TE_{10}$ mode rectangular waveguide. The phase of individual slots in the stripline array can be arbitrarily controlled by manipulating the length of the inner conductor. The stripline characteristic impedance is easily varied by altering the width of the same conductor, a desirable feature. Extreme compactness in two-dimensional slot arrays can be achieved by use of printed circuit fabrication techniques for the slot radiators, the stripline center conductor and the feed network. The TEM line is also nondispersive, thus enabling distortion free transmission of short pulse and other more complex waveforms.

BRIEF DESCRIPTION OF THE DRAWINGS

FIG. 1 is a partly schematic plan view of a prior art slot array with a corporate feed;

FIG. 4A is a schematic, partly perspective view of a boxed stripline slot module and FIG. 4B a schematic diagram of an equivalent circuit of an Nth module of FIG. 4A.

DETAILED DESCRIPTION OF THE PRESENTLY PREFERRED EMBODIMENT

Figure 2A:
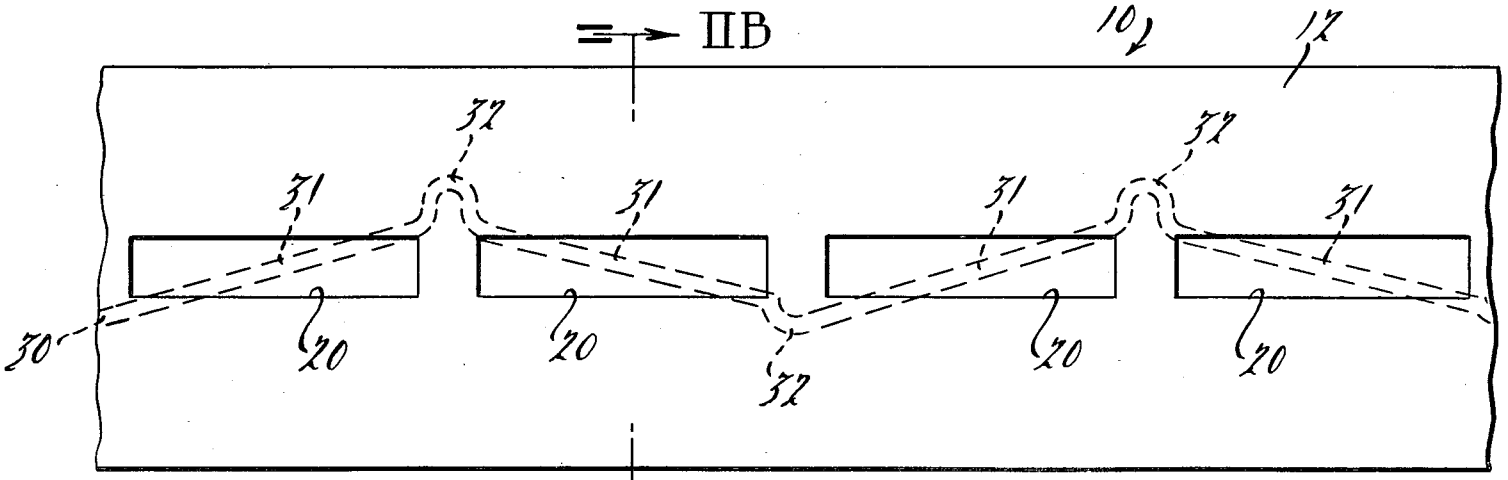
FIG. 2A and 2B are a plan and end view, respectively, of a stripline fed collinear slot array in accordance with an embodiment of this invention including a single conductor feed which is angled with successive linearly aligned slots.
Figure 2B:
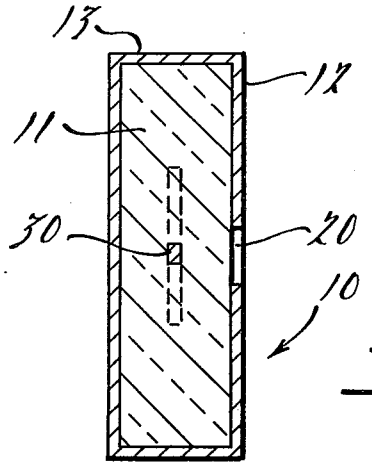

A boxed stripline fed slot array 10 is generally elongated with a face 12 having a plurality of collinearly aligned slots 20. The cross section of stripline fed slot array 10 is generally rectangular, one of the long sides being face 12. The exterior of slot array 10 is clad in an external conducting material 13. The interior or array 10 includes a dielectric 11 wherein is supported a feed conductor 30. Feed conductor 30 includes a plurality of conductor segments 31 alternating with connecting bends 32.

Slots 20 are elongated, generally rectangular openings in face 12 and aligned along their long edges, the short edges being perpendicular to the axis of alignment. Each of conductor segments 31 is generally framed about a slot 20 and is angled in an alternating fashion with respect to the axis of alignment. That is, a first conductor segment 31 associated with a first slot 20 is angled in a first direction with respect to the axis of alignment and an adjacent conductor segment 31 associated with an adjacent slot 20 is angled in an opposite directions from the first direction. The change in direction between adjacent conducting segments 31 is accomplished by connecting bend 32, a generally integral, semicircular portion of feed conductor 30. Typically, connecting bend 32 is outside of the region framed by a slot 20.

Figure 3:
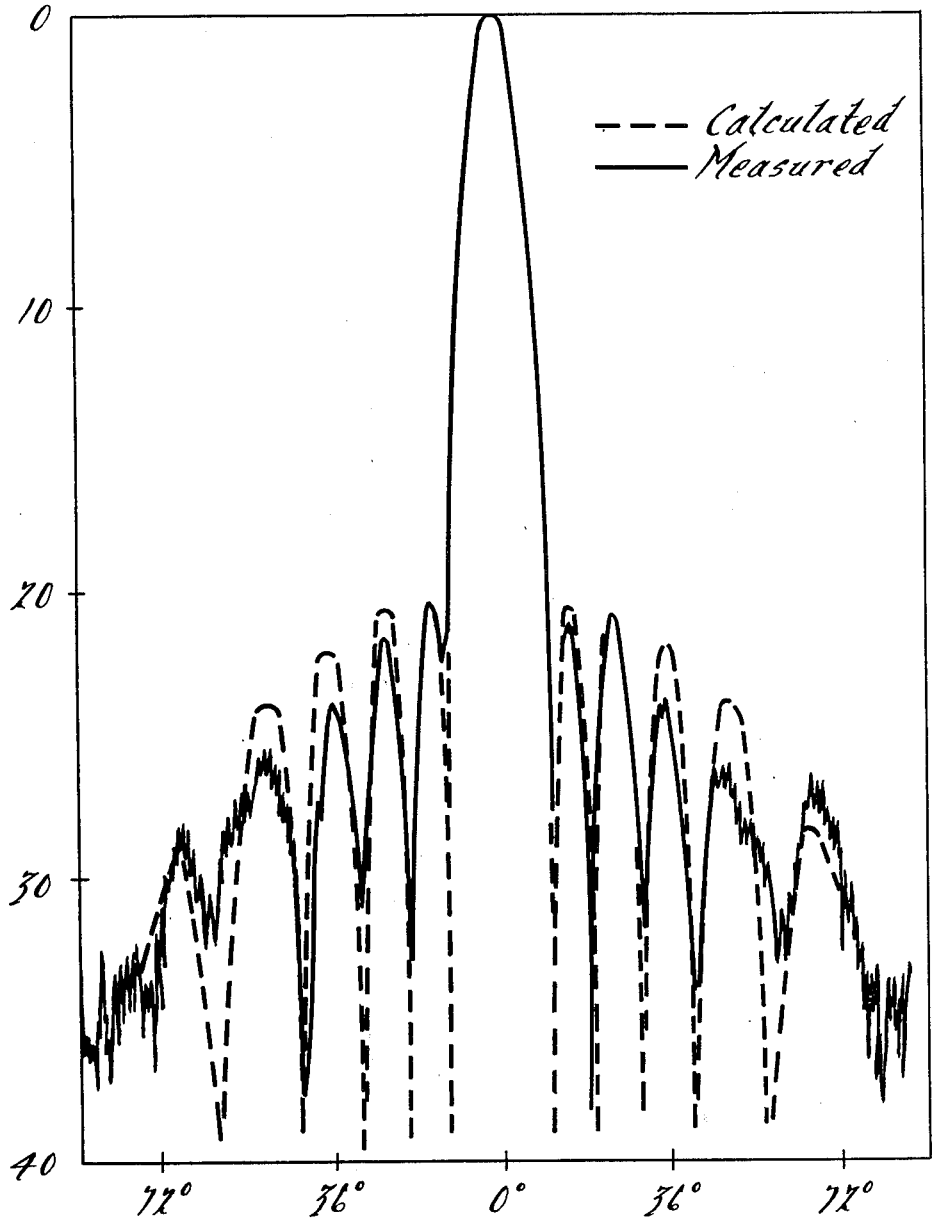
FIG. 3 is a graphical display of the calculated and measured patterns for a 20 dB Chebyshev array in accordance with an embodiment of this invention.

In accordance with an embodiment of this invention, slot array 10 can be fed at the center of the strip by a right angle coaxial connector (not shown). Slot array 10 can be fabricated using photo-etch printed circuit techniques. The slots and the center conductor can be printed on opposite sides of the same copper clad dielectric board. A second board, clad on one side completes the sandwich. The sides and ends of the sandwich can be plated to form the metallic box. A 10 slot array has been designed to produce a broadside main beam with first sidelobes 20 dB down from the main beam peak. The calculated and measured radiation patterns are shown in FIG. 3, and are seen to be in close agreement. The measured array gain is 10.6 dB, which is consistent with the beamwidth and ground plane size used in the test. The ten element array was designed using an analysis of the fields within the guide coupled with an array design theory.

DEVELOPMENT OF ARRAY THEORY OF LONGITUDINAL SERIES SLOTS IN A TEM LINE

In a TEM line, a series slot element can be obtained by inclining the slot and center strip relative to each other, so that the slot interacts with longitudinal current flow. There are two basic problems to solve in order to design a slot array in a TEM line:

1. How to reduce the resonant slot length to enable half wavelength spacing;
2. How to include effects of mutual coupling between slots.

1. Control of Slot Resonant Length

The dimensions of a transmission line are usually chosen so that all higher order modes cannot propagate. In the previously cited Strumwasser et al experimental study, the width of the TEM line was chosen to be much less than the cut off width for the fundamental $TE_{10}$ waveguide mode. The resonant slot lengths proved to be considerably longer than half a free space wavelength. The reasons for this are now understood. The equivalent circuit of a transverse cross section of the boxed stripline appears as two short circuited parallel plate lines in parallel with the slot element. The shorted line sections inductively load the slot, requiring that the slot length is greater than a half-wavelength (capacitive) in order to attain resonance. In order to achieve slot length of a half-wavelength, the line width must be more than the cutoff width of the $TE_{10}$ mode.

This meant that asymmetrical structures, such as the inclined slots used by previous investigators, could cause conversion of wave energy from the TEM mode to the $TE_{10}$ mode. In accordance with an embodiment of this invention, there are used non-inclined collinear slots on the center line of the TEM boxed line. The strip is inclined underneath the slots, thus coupling energy to the radiating elements. These centered, collinear slots do not interact with the longitudinal currents of a $TE_{10}$ wave, thereby enabling the use of guide width above the $TE_{10}$ cutoff dimension. As is well known, cutoff for the $TE_{10}$ mode is an electrical half wavelength at the operating frequency.

Proper choice of guide width proved successful in achieving desirable slot lengths. Other benefits of the centered collinear slots include no gain loss from cross polarization and no second order beams or cross-polarized lobes in two dimensional planar arrays.

2. Relation Between Mode Current and Slot Voltage

Consider the module consisting of the solid lines shown in FIG. 4B. This is a section of the boxed stripline containing a longitudinal slot of length 2l and located in the center of its broadwall. The module of FIG. 4A is a two-port device, the ports being at $Z=\pm\lambda_{TEM}/4$, where $\lambda_{TEM}$ is the wavelength of the TEM mode. The origin is taken in the boxed stripline cross section which bisects the slot.

No loss of generality occurs if the ports are taken at the positions $Z=\pm\lambda_{TEM}$, shown dotted in FIG. 4A, because relations between the two sets of ports involve, simple, known, linear transformation. With this convention adopted, the equivalent circuit for the nth module is as shown in FIG. 4B.

This equivalent circuit is subject to the interpretation that, in the boxed stripline, only the TEM mode is of interest because the centered longitudinal slot does not excite the waveguide $TE_{10}$ mode. This TEM mode is represented by the voltage/current pair $V_n$, $I_n$ at the input port ($Z=-\lambda_{TEM}$). A load impedance $Z_n^L$ is placed at the output port ($Z=\lambda_{TEM}$). This impedance, transformed through $3\lambda_{TEM}/4$, could represent what the nth module "sees" looking down its branch line at all the slots beyond, or could be an appropriate termination, such as a short circuit. The active impedance $Z_n^A$ is an important parameter in this analysis and its meaning can be appreciated by considering the interelations among all the slots. It has been found that the active impedance at the terminals of the nth module equals the self impedance of the nth slot plus a term which accounts for mutual coupling. This latter term is a summation which involves not only the mutual impedances between ports, but also the relative currents at the different ports. The active impedance $Z_n^A$, is decisive in determining the amplitude and phase of the electric field in the nth slot. Since the latter is dictated by the desired radiation pattern, $Z_n^A$ becomes the focal point of array design. The mode voltage and current at any cross section in FIG. 4B can be represented by:

$$V(z) = A\,e^{-j\beta Z} + (B + D)\,e^{j\beta Z} \tag{1}$$

$$I(z) = \frac{1}{Z_o}\,[A\,e^{-j\beta Z} - (B + D)\,e^{j\beta Z}]\quad z < 0$$

$$V(z) = (A + C)\,e^{-j\beta Z} + D\,e^{j\beta Z} \tag{2}$$

$$I(z) = \frac{1}{Z_o}\,[(A + C)\,e^{-j\beta Z} - D\,e^{j\beta Z}]\quad z > 0$$

in which lossless walls are assumed, a factor $e^{j\omega t}$ has been suppressed, $Z_o$ is the characteristic impedance of the strip fed waveguide for the TEM mode and $3=2\pi/\lambda_{TEM}$.

Further, mathematical development is discussed in a dissertion thesis entitled "Theory, Analysis, and Design of a New Type of Strip-Fed Slot Array" by Pyong Kiel Park submitted to the University of California, Los Angeles, 1979. From that work it has been found that the strip tilt angles ($O_n$) and the slot lengths ($l_n$) for a given aperture distribution ($V_n^s$) may now be determined as $$I_n = F_n(\theta_1, \ldots, \theta_N, l_1, \ldots l_N)\, V_n^s \quad n = 1, 2, \ldots N \tag{3}$$

Since the magnitudes of the mode currents are equal for a resonant N-slot linear array, the mode current $I_n$ may be eliminated by taking the difference between the values of equation (3) for any two values of n, i.e., $$0 = F_n(\theta_1, \ldots, \theta_N, l_1, \ldots l_N)V_n^s - F_j(\theta_1, \ldots, \theta_N, l_1, \ldots l_N)V_j^s \tag{4}$$

$$n = 1, 2, \ldots j-1, j+1, \ldots N$$

If the (N−1) possible equations are partitioned into real and imaginary components, 2(N−1) independent nonlinear equations result, in the 2N unknowns $\theta_n$ and $l_n$. The two additional equations required to enable solution are obtained by constraining the strip-fed waveguide input impedance to satisfy the complex relation $$Z_{IN} = \sum_{n=1}^{N} Z_n^A \tag{5}$$

where $Z_{IN}$ is the matching condition. This process can obviously be extended to a two-dimensional array of several waveguides.

The following table shows computed array design data obtained by applying a 20 dB Chebyshev distribution to a ten-element linear slot array and to a 2×10 rectangular array of slots, both in boxed stripline. Utilizing symmetry one need only calculate strip tilt angles and lengths for half the array, or five elements.

| | 10 Slot Linear Array | | 10 × 2 Slot Array | |
|---|---|---|---|---|
| No. of Element | Tilt Angle (degree) | Slot Length (inch) | Tilt Angle (degree) | Slot Length (inch) |
| 5 | 0.80231E 01 | 0.16427E 01 | 0.68598E 01 | 0.16691E 01 |
| 4 | 0.73188E 01 | 0.16429E 01 | 0.62236E 01 | 0.16690E 01 |
| 3 | 0.61158E 01 | 0.16419E 01 | 0.52363E 01 | 0.16693E 01 |
| 2 | 0.46446E 01 | 0.16487E 01 | 0.37611E 01 | 0.16774E 01 |
| 1 | 0.46969E 01 | 0.16357E 01 | 0.41507E 01 | 0.16642E 01 |

I claim:

1. A slot array antenna comprising:

a dielectric-filled electrically conductive box having four electrically conductive faces elongated along a longitudinal axis, each face having a width dimension orthogonal to the longitudinal axis, each cross-section of said box orthogonal to said longitudinal axis being substantially rectangular, whereby two of the faces have relatively narrow widths and two of the faces have relatively wide widths;

cut out of one of the relatively wide width faces, several collinearslots, each slot being aligned and elongated along a single long axis, said long axis being parallel to the longitudinal axis and bifurcating said cut face into two substantially equal halves; and one continuous stripline feed conductor for exciting said slots, said conductor being imbedded within said dielectric, roughly disposed in the direction of said longitudinal axis, wherein said conductor comprises several segments each of which is angled with respect to the long axis depending upon the desired amount of energy to be coupled from said segment to its nearest slot;

wherein the electrical width of each of said relatively wide width conductive faces is greater than one-half wavelength at the desired frequency of operation of said antenna.

2. A slot array antenna as recited in claim 1 wherein said conductor forms a zig-zag pattern, wherein adjacent segments are angled differently with respect to the long axis.

3. A slot array antenna as recited in claim 2 wherein the absolute magnitude of the angle between each segment and the long axis is the same for all segments.

4. A slot array antenna as recited in claim 3 wherein adjacent pairs of segments are each connected by a curved portion of conductor in a region of the dielectric between corresponding adjacent slots.

5. The antenna of claim 1 wherein adjacent slots are one-half of a wavelength apart, and the elongated dimension of each slot is less than one-half of a wavelength.

6. The antenna of claim 5 wherein the shape of each slot in the plane of the cut face is rectangular.

7. The antenna of claim 1 wherein the $TE_{10}$ mode, as well as the TEM mode, is allowed to propagate within the box, thus allowing control of the elongated dimension of each slot at resonance.

8. The antenna of claim 7 wherein the TEM mode excites the slots but the $TE_{10}$ mode does not excite the slots.

* * * * *